United States Patent [19]

Russo et al.

[11] Patent Number: 4,662,085

[45] Date of Patent: May 5, 1987

[54] PIN OVEN LOUVER DESIGN

[75] Inventors: Adolph D. Russo, Cleveland; Milan Zec, North Olmsted, both of Ohio

[73] Assignee: Feco Engineered Systems, Inc., Cleveland, Ohio

[21] Appl. No.: 676,383

[22] Filed: Nov. 29, 1984

[51] Int. Cl.[4] ..... F26B 15/20

[52] U.S. Cl. ..... 34/105; 34/224; 34/225; 34/239

[58] Field of Search ..... 34/104, 105, 106, 224, 34/225, 232, 233, 239; 118/58

[56] References Cited

U.S. PATENT DOCUMENTS

| | | | |
|---|---|---|---|
| 1,412,598 | 4/1922 | Ayres et al. | 34/225 |
| 3,755,916 | 9/1973 | Gulaian | 34/218 |
| 3,866,331 | 2/1975 | Evans | 34/233 |
| 4,050,888 | 9/1977 | Pfister et al. | 34/105 |
| 4,165,966 | 8/1979 | Whelan et al. | 34/105 |
| 4,492,571 | 1/1985 | Miura | 34/105 |

FOREIGN PATENT DOCUMENTS

| | | | |
|---|---|---|---|
| 2536516 | 5/1984 | France | 34/106 |

*Primary Examiner*—Albert J. Makay
*Assistant Examiner*—David W. Westphal
*Attorney, Agent, or Firm*—Patrick J. Walsh

[57] ABSTRACT

A pin oven is disclosed for curing coated or decorated can bodies travelling in a serpentine path wtih jets of a curing medium. The pin oven chamber is divided by an interior louver wall into a curing medium supply plenum chamber and a curing chamber. The cans move through the oven on a pin conveyor and jet nozzles in the louver wall are arranged in a pattern for instantaneously confronting moving can bodies with substantially the same number of nozzles for immersing the can bases in a substantially uniform air stream in order to minimize can flip-flopping on the pin conveyor in order to achieve oven speeds in excess of 1000–1200 cans per minute. The louver wall is provided with chambers for uniformly distributing the pressure and velocity of air jets to reduce the tendency of cans to pulsate as they pass through the oven. The louver walls are of modular construction for application of the oven to a variety of can sizes and decorating or coating technologies.

10 Claims, 5 Drawing Figures

106
26
C
56
104
108
44
54
96
97
32
28
34
AIR FLOW
86
88
99
118
110
98
98
108
44
54
112
116
114
C
120
124
56
26
126

PIN OVEN LOUVER DESIGN

BACKGROUND OF THE INVENTION

Two-piece metal cans are in widespread use in packaging a variety of domestible products, particularly beer and beverage products. Typically, such metal cans are fabricated of aluminum or steel including a one-piece open-ended can and a can end for sealing the can. During the course of manufacture the outside surface of the can is decorated (printed) with a label and overvarnished to protect the printing and the surface of the can. Additionally, in case of steel cans and some aluminum cans a coating is applied to the exterior surface of the can prior to printing. Lastly, a sanitary coating is applied to the interior of the can.

For proper application of the coatings or printing inks, it is necessary to "bake" the cans in an oven after coating or printing to achieve a proper cure. Also, the cans have to be cooled after baking in a cooler attached to the oven. For curing the exterior coating or decorative printing and overvarnish, the cans are heated in pin ovens in which a pin conveyor in the form of endless conveyor chain is fitted with a series of pins for receiving and carrying can bodies through the curing oven and through the cooler. In a typical pin oven the conveyor chain is arranged in a serpentine path in which the conveyor with cans makes several vertical passes through drying or curing zones in the oven and through the cooler. The pin conveyor with cans initially moves vertically upwardly through the first pass, reverses direction to move vertically downwardly in the second pass and so forth until the cans leave the oven and the cooler. As the cans traverse each pass, a series of hot air jets issuing from nozzles along the path of travel heat cure the exterior decorative coating or printing on the can and similarly cool the cans with cold air when passing through the cooler.

For efficient manufacturing it is desirable for the cans to move as quickly as possible through the oven. Under conventional operating conditions a pin oven will cure up to approximately 1000 to 1200 cans per minute.

Since the cans are carried on pins extending into their open ends, the cans tend to "flip-flop" under the influence of centrifugal force as they reverse direction at the end of each vertical path. Additionally, each can receives a series of pulses from curing air jets as it enters each vertical run after reversing direction. At speeds above 1000–1200 cans per minute the forces generated during flip-flop and by air jet pulses tend to inflict unacceptable damage on the cans including body damage and damage caused by cans falling off their carrier pins. Damaged cans cannot be used for packaging. Accordingly, in current practice, pin ovens are limited to this speed range.

According to present pin oven design, the oven is divided by interior walls into three chambers including a supply air plenum chamber containing hot curing air, a curing chamber, and a return air plenum chamber. The interior walls include a louver wall defining the supply air plenum chamber and for issuing curing air jets into the curing chamber, and a perforated wall defining the return air plenum chamber for receiving curing air exhausting from the curing chamber. The louver wall and the perforated wall are arranged in confronting, substantially parallel planes to define the curing chamber. The louver wall is performated in a nozzle pattern extending along each vertical path and along the circular path connecting alternate up and down passes through the oven. In the vertical paths the nozzles are arranged in typical patterns of clusters of four nozzles each spaced laterally on either side of the centerline of vertical travel and with each cluster located on given centers in the direction of conveyance. These cluster nozzle groups issued air jets impinging on the base of can bodies. In addition a series of angled nozzles are spaced in confronting relationship to the can sidewall for directing hot air toward the can wall for curing the can body. The nozzles issue discrete hot air jets which impinge on and cure surface decoration according to the oven application. Applicants have determined that the nozzle design heretofore used in fact contributes to a pulsating action of jets against can body which becomes exaggerated at higher oven speeds resulting in unstable can body motion at speeds in the 1000–1200 cans per minute range. This results in increased can damage and loss of cans falling off the carrier pins.

The circular path between vertical passes in conventional design typically contains a pair of rows of nozzles in the vertical dividing panel along inner and outer radii straddling the centerline of conveyance. By reason of the influence of centrifugal force, the circular path is one of particular turbulence for the can bodies. The existing nozzle design does little to promote can stability at high speeds in this area.

In existing ovens it is common to have the louver wall affixed to the oven walls with the rear face of the louver wall reinforced with vertically and/or horizontally arranged angle irons to withstand air supply plenum chamber pressures of up to 18 psi. A pressure drop wall may also be used behind the louver wall extending the full length thereof. In other cases no pressure drop wall is used and the reinforced louver wall forms the sole dividing member between the air supply plenum and the curing chamber. With both these arrangements the angle irons and the pressure drop plate where used contribute to turbulence in the curing air stream within theove and in the air jets issuing through the louver wall. Turbulent air jets contribute to can instability including flip-flopping on carrier pins especially at higher speeds.

In the design and construction of pin ovens, the pattern of nozzles for issuing hot air jets for curing can bodies is determined specifically for a given size can body in order to achieve optimum curing conditions for the specified can body. Additionally, the oven speed is also selected according to desired residence time of can bodies within the curing zone. Residence time is determined to a large extent by types of coatings or inks used and the type of solvents used. In practice, can manufacturers will also attempt to cure different size cans in an oven with the result that on occasion there is a serious mismatch between can size and oven speed and nozzle pattern. The mismatched cans lose stability as well as temperature uniformity as they move through the oven. Without temperature uniformity can bodies may be overcured in certain areas and undercured in other areas. As noted, can instability results in can damage.

Therefore, pin ovens currently in use are limited to a speed range of approximately 1000–1200 cans per minute. The ovens are designed for a given size of can, and as occurs in practice, ovens are used for different sized cans sometimes resulting in a mismatch between can and oven. Such mismatches result in improperly cured cans, burnt cans, and cans with damage to body or decoration due to an unstable ride through the oven.

The presently used nozzle patterns issue air jets in patterns tending to pulsate cans on their carrier pins and contribute to can instability and loss, especially at the upper range of operating speed.

SUMMARY OF THE INVENTION

The present invention is directed to a new and useful design for pin ovens to reduce unwanted can flip-flopping and to provide a stable ride for cans moving through the oven so that conveying speeds substantially above the present range of 1000–1200 cans per minute can be achieved.

According to the invention, each vertical path of the oven is fitted with a unique louver design which reduces the pulsating action of curing air jets impinging on the bottoms and the cylindrical side walls of the can bodies. In a preferred form of the invention the vertical conveying path through which cans move is fitted with spaced louvers which issue converging air jets forming continuous air curtains directed substantially at the mid-cylinder portion of each can body riding on the pin conveyor. The louver is provided with a continuous pattern of nozzles for directing air jets in a continuous stream toward the base of each can. The action of the converging air curtains is effective to draw the base air jets outwardly along the side walls of the cans to promote curing.

In another aspect of the invention, a unitary main louver section has a louver face arranged into a plurality of passes aligned with the serpentine path cans follow in moving through the oven and with each louver pass having the louver design of this invention. The main louver section further includes a corresponding plurality of pressure drop plenum chambers individually fitted to the louver passes. In a preferred embodiment six louver passes with their pressure drop plenum chambers are joined in unitary construction to form the main louver section. In addition a corresponding number of upper radius return sections with louver faces and pressure drop plenum chambers are joined to and from part of the main louver section and define the circular path bridging adjacent passes in the serpentine can path. In this form the main louver section as a unit may be installed by bolting or welding to the oven walls. In practice the main louver section is mounted on a plurality of modular lower radius return sections defining the circular paths bridging the lower ends of each pass. The upper and lower sections have perforated louver faces with a novel nozzle design according to the invention. The lower sections are similar in design to the upper section in having individual pressure drop air plenum chambers.

By reason of the main louver section design and that of the lower radius return sections, curing air flows from the air supply plenum chamber through the pressure drop plenum into the curing chamber in a direction substantially perpendicular to the perforated front louver face in a manner to minimize turbulence of issuing air jets, to promote can stability, and to enable higher operating speeds.

Applicants have determined that the louver sections perforated with air nozzles according to the invention can provide an optimum air pattern for cans of a range of sizes and consistent with increased oven speeds of up to 1500 cans per minute. Such sections may be individually designed for interchangeability so that can manufacturers may change oven panels for optimum curing for different can configurations and coatings.

OBJECTS OF THE INVENTION

Accordingly, it is an object of the invention to provide a pin oven having unique louver design for issuing air jets so as to reduce unwanted can motion and consequent can damage thereby to increase substantially the operating speeds of pin ovens.

It is a further object of the invention to provide a pin oven for issuing air jets to form a continuous air stream for curing the base and lower side walls and of converging air jets forming continuous air curtains for curing the upper side walls of containers.

Another object is to provide air patterns for air jets which cooperate for curing cans and which substantially reduce can pulsation.

An object of the invention is to increase oven speeds up to 1500 cans per minute.

Another object of the invention is to immerse cans in a continuous air curtain for even and rapid curring resulting also in reduced time of residence in the oven and smaller ovens.

Another object is to provide oven louver panels having nozzle patterns optimized for different can configurations so a standard oven may be used for a variety of can bodies.

Another object of the invention is to provide louver sections in modular form for improved construction, maintenance and operation of ovens for curing cans.

Other objects of the invention will occur to persons skilled in the art of employment of the invention in practice and from the accompanying detailed description.

DETAILED DESCRIPTION OF THE DRAWING

A preferred embodiment of the invention has been chosen for illustrating the principles thereof in the accompanying drawing in which.

DETAILED DESCRIPTION OF THE INVENTION

Figure 1:
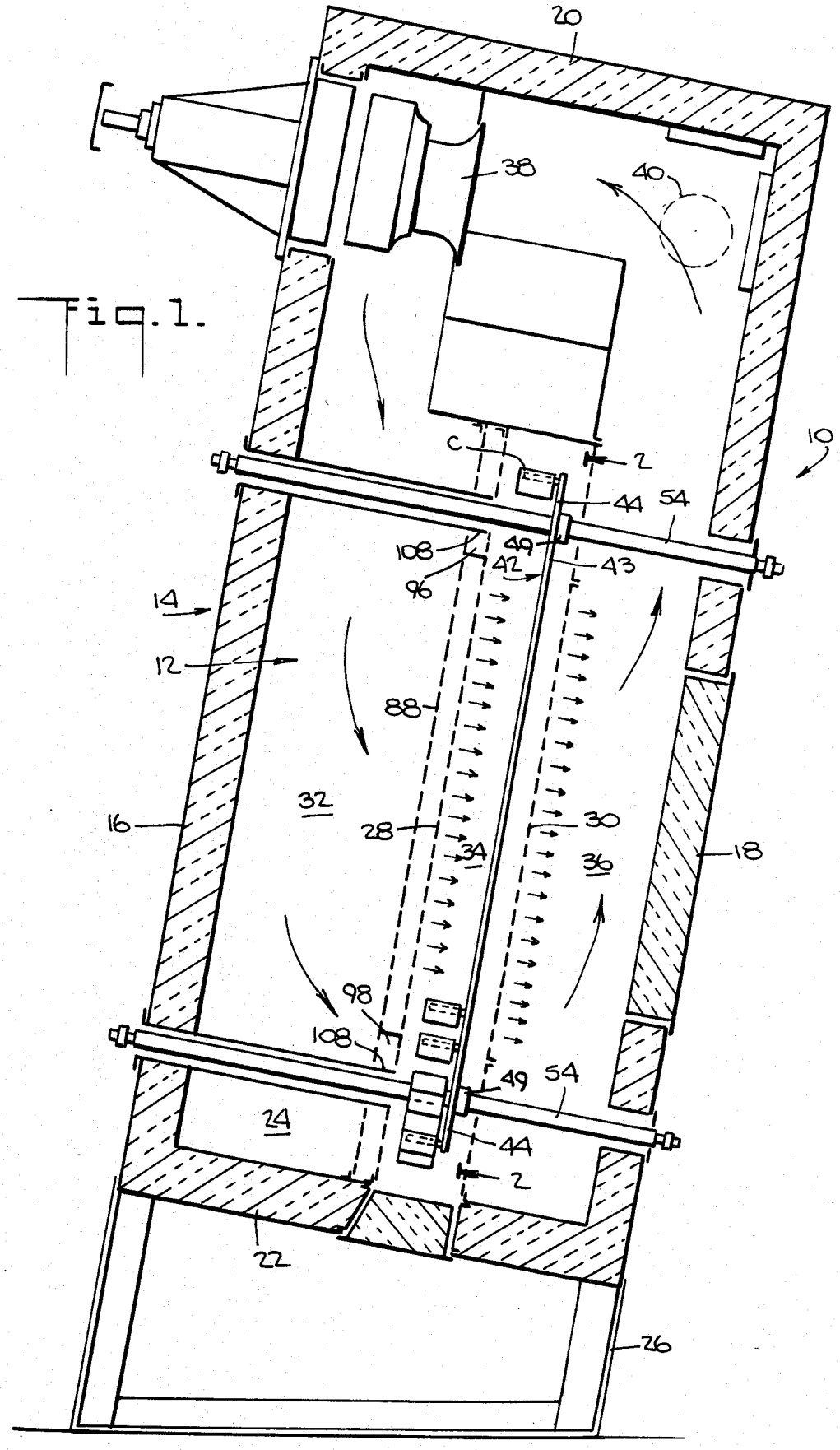
FIG. 1 is a side elevation view in section of the interior of a pin oven particularly illustrating the air supply plenum chamber, the curing chamber, and the return air plenum chamber.
Figure 2:
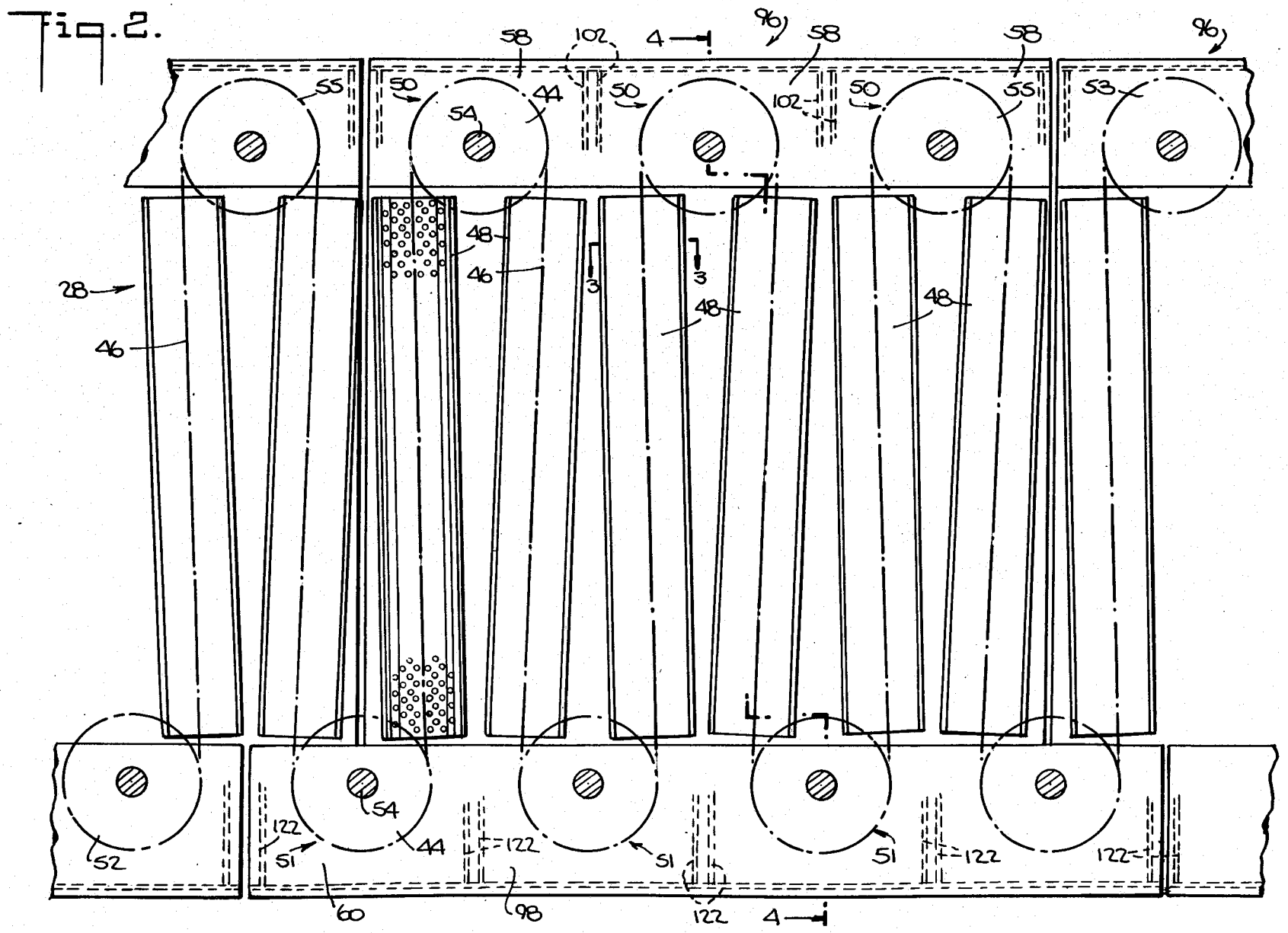
FIG. 2 is a section view taken along line 2—2 of FIG. 1 and illustrating the path followed by can bodies moving through the oven.

Referring now to the drawing and particularly to FIGS. 1 and 2, a pin oven 10 according to the present invention comprises an enclosed oven chamber 12 defined by an exterior boxlike structure 14 having front 16, rear 18, top 20, bottom 22, and end 24 walls supported by an oven frame 26. The oven chamber 12 is divided by interior upstanding wall members 28 and 30 into an air supply plenum chamber 32 for the curing medium, usually hot air, a curing chamber 34 through which cans pass on a can conveyor for curing their exterior coating or printing and overvarnish, and a return air chamber 36 through which the air returns to a 38 recirculation fan and burners 40 to reheat the air. Ordinarily pin ovens are inclined slightly from the vertical as shown in FIG. 1 as an aid in holding can bodies to the pin conveyor. In the following description the path followed by cans through the oven is described as being serpentine with vertical passes and reversing zones. It is to be understood that this description includes substantially vertical paths followed in such inclined ovens.

Can bodies C are carried through the oven by a pin conveyor 42 comprising an endless carrier chain 43 with extended can carrying pins 56 (FIG. 3) preferably located on 5.25 inch centers along the length of the chain. The chain is arranged in a serpentine manner over a series of upper and lower sprocket members 44, defines a conveying path designated in FIGS. 2 and 5 as the carrier chain centerline 46, and is characterized by a series of generally vertical passes 48 connected by upper and lower circular reversing zones 50 and 51. The sprockets include entrance 52 and exit sprockets 53 as well as intervening reversing sprockets 55 defining the circular reversing zones 50 and 51 between the vertical 48. The sprockets 44 are suitably mounted for rotation on hubs 49 which are heat shrunk to shafts 54 supported by the oven and driven in a conventional manner. The chain is fitted with a series of pins 56 throughout its length for receiving and carrying cans through the oven.

Figure 3:
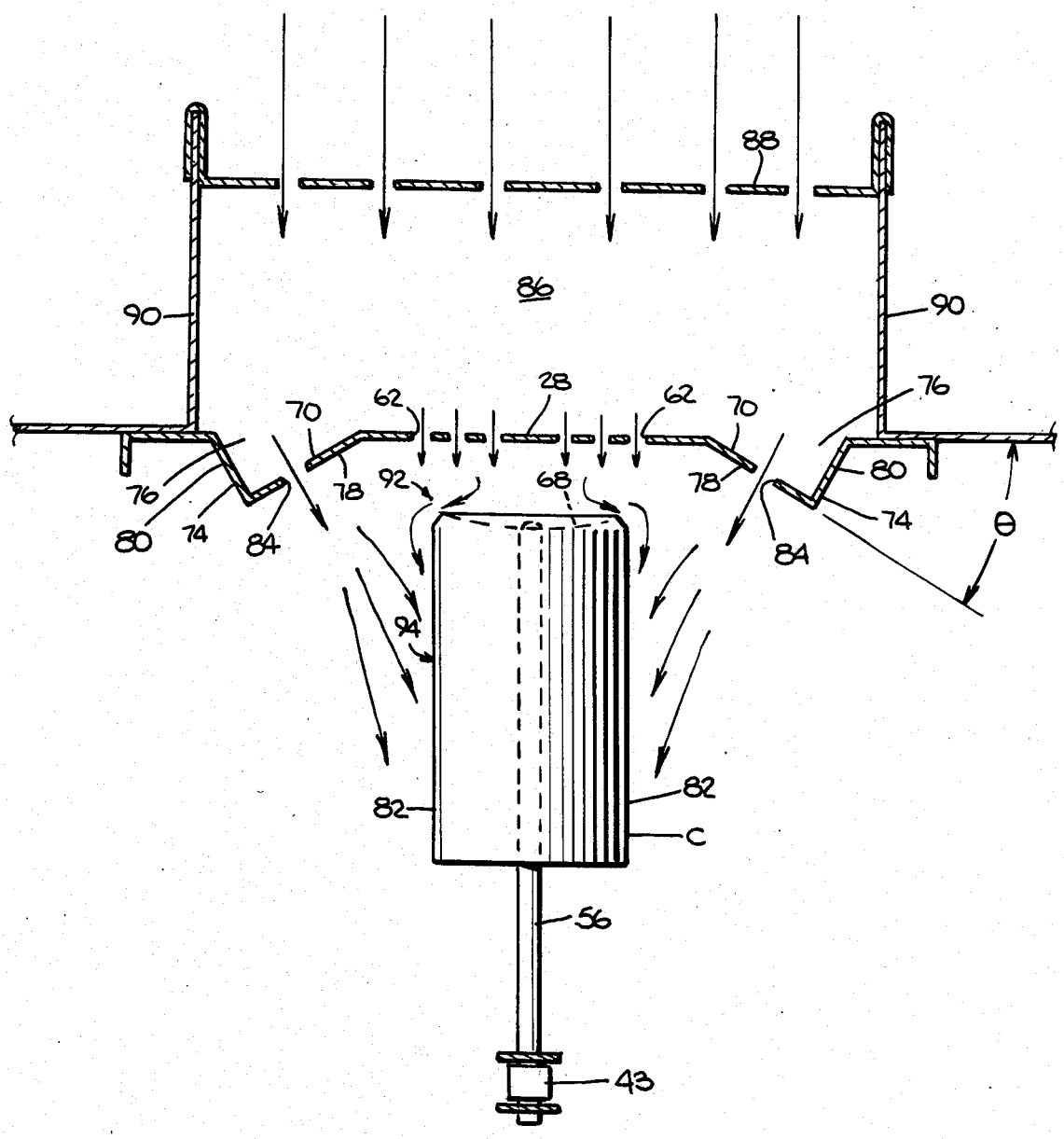
FIG. 3 is an enlarged section view taken along line 3—3 of FIG. 2 and illustrating the air pattern directed toward a can body.
Figure 5:
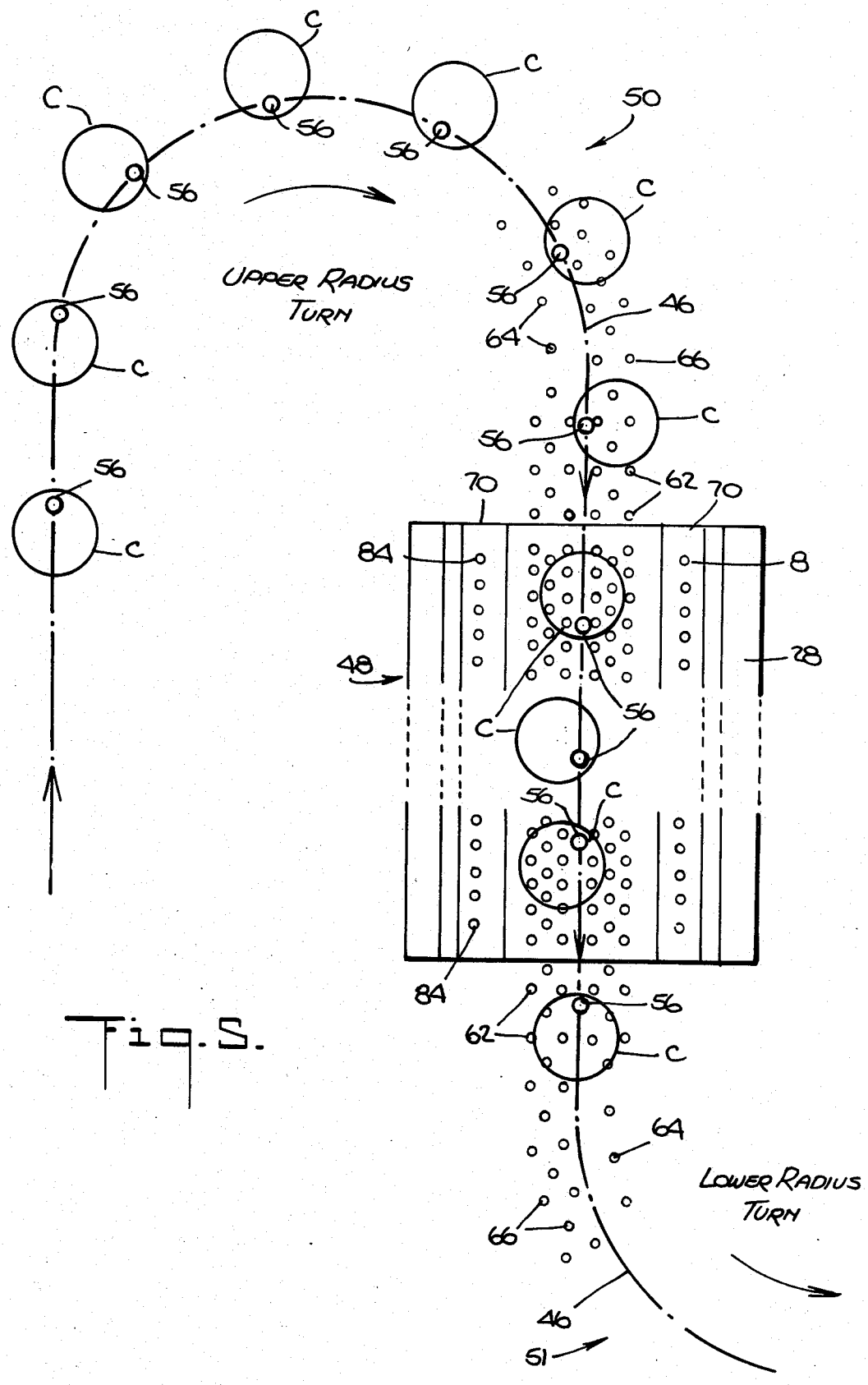
FIG. 5 is a fragmentary view of the vertical and return conveying path illustrating in particular the preferred nozzle pattern as well as the effects of centrifugal force on conveyed can bodies.

The interior louver wall 28 defines a series of spaced curing passes 48 through which cans pass as they move through the oven. For example, the first curing pass of the oven extends frm the entrance sprocket 52 to the first reversing sprocket 55 along the surface of the interior louver wall. The conveying pin chain 43 extends tangentially between these sprockets along centerline 46 indicating the path followed by can bodies. The interior louver wall includes upper 58 and lower 60 radius turn sections defining an entrance path into the first vertical pass and a series of intervening reversing zones 50 and 51. As shown in FIGS. 2, 3, and 5, the interior louver wall is provided with a plurality of offset rows of perforations 62 arranged on centerlines located on either side of the centerline 46 of the conveying path. These rows extend substantially the full length of the vertical conveying path 48 between sprockets 44. Additionally, rows of perforations 64, 66 extend along concentric circles in each reversing zone between vertical passes. It will be observed that for each radius turn, the inner nozzle pattern 64 includes a single row of nozzles and the outer nozzle pattern 66 includes a continuation of the plurality of offset rows of perforations 62. Each of these perforations defines a nozzle for issuing hot air jets from air supply plenum chamber 32 to curing chamber 34 for impinging on the bottom panel 68 of each can body C for purposes of curing and holding the cans to their carrier pins.

As shown in FIG. 5 the cans C are subjected to the action of centrifugal force being thrown outwardly as they leave a straight curing pass and are carried around each sprocket through the reversing zones 50 and 51. The arrangement of nozzles in each radius turn provides air jet forces which are substantially uniform and provide a stabilizing effect for the cans riding around the radius turns. Moreover, as each can leaves the reversing zones 50 and 51 and enters the next straight line pass 48, the forces on the can including centrifugal force and the action of air jets issuing through nozzles 62, 64, 66 at the entrance to each pass minimizes the tendency of the cans to flip-flop on their pins.

The interior louver wall nozzle pattern also includes spaced, converging side louvers 70 shown in FIGS. 3 and 5 positioned on either side of the can path 46 through each vertical oven pass. Each side louver 70 comprises an angled header 74 defining an air chamber 76 having front 78 and side walls 80 forming an integral part of the interior louver wall 28. Each front wall 78 is arranged at an acute angle $\theta$ with respect to the louver wall 28 so that the front walls of cooperating louvers in each pass direct converging air jets (indicated by arrow) toward the upper wall portion 82 of the can bodies moving through the oven. The front walls of each side louver are perforated to form nozzles 84 for issuing air jets for curing the can bodies. Preferably, the perforations in the front wall 78 are located on centers sufficiently close to provide a continuous curtain of curing air acting on the container side wall.

Figure 4:
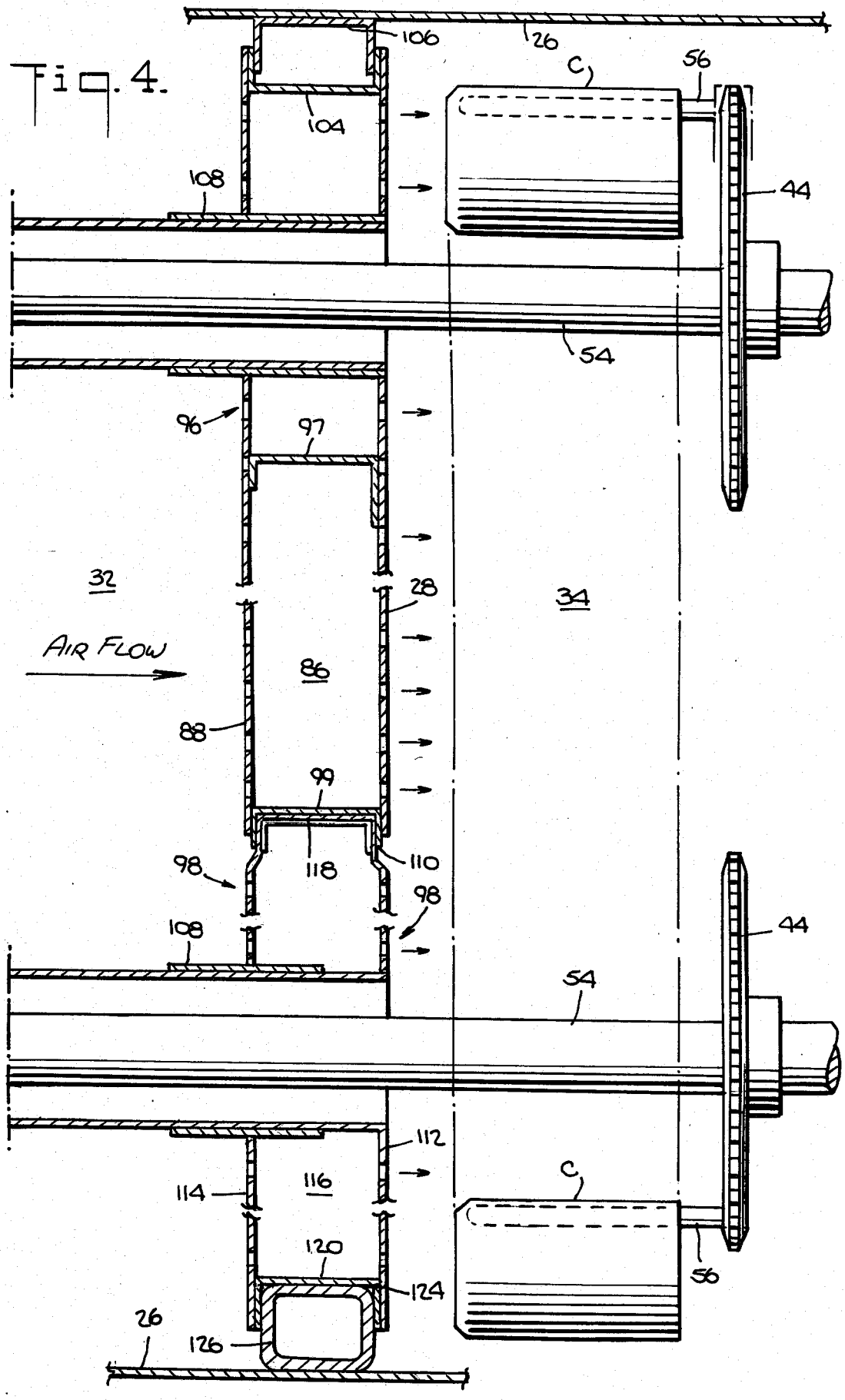
FIG. 4 is an enlarged fragmentary section view taken along line 4—4 of FIG. 2.

It is a further aspect of this invention that each louver wall 28 is provided with an individual air straightening pressure drop chamber 86 defined by a perforated rear plate 88 and imperforate side walls 90 shown in FIGS. 3 and 4. By this arrangement the air from the recirculating fan 38 arrives at chamber 86 and nozzles 62, and 84 flowing in a direction substantially perpendicular to the louver wall 28. The imperforate side walls 90 extend the full vertical length of the louver wall to prevent any sidewall movement of the air in case of a pressure differential between adjacent pressure drop chambers 86 or in case of pressure differentials within the air supply plenum chamber 32.

By this arrangement of the nozzles 62 and 84 and the individual air straightening plates 88 attached to the louver wall, the pressure and velocity of air jets impinging on each can are substantially uniformly distributed thereby reducing the tendency of the cans to pulsate and providing a stable ride as the cans enter and pass through the oven.

As shown in FIG. 3 the base air nozzles 62 now issue a substantially coherent air stream of uniform pressure, velocity, and distribution immersing the base portion 92 of each can body in hot curing air as it passes each vertical run. There is substantially no pulsating action as the cans are carried. At the same time, the converging air nozzles 84 issue air jets directed to impinge the upper portion 82 of the can side wall. The air nozzles are spaced so that collectively they issue air jets which define a substantially continuous air curtain impinging the upper portion of the can side wall and the lower to mid side wall 94 portion of each can body. The air curtains are substantially uniform in terms of pressure, velocity and air distribution so there is little or no pulsating of can bodies on the carrier pins even at elevated can speeds. Additionally, the ar curtains draw base air jets along the side wall of each can to promote uniform curing.

In the lower and upper radius turns the can bodies fly outwardly on their pins 56 as shown in FIGS. 3 and 5 under the influence of centrifugal force. Applicants have determined that a continuation of the plural rows of base air nozzles 62 into the radius turns provides nozzles 66 which impinge on the base of each can body giving it a stable ride minimizing flip-flop. These plural rows of nozzles 66 are located along an outside concentric path with respect to the centerline of pin conveyor travel. In addition, a single row of nozzles 64 follows an inside concentric track. The outer and inner track nozzles issue an air stream which immerses the bottom of each can with little orno pulsation due to variations in air pressure, velocity, or distribution.

The selection of nozzle spacing and orientation in both the base 62 and side wall nozzles 84 is determined primarily by can body configuration and the process conditions for curing particular coatings. As shown in FIGS. 3 and 5, the side wall nozzles 84 are oriented to issue air jets which impinge the upper body of the side wall, which is a relatively heavy portion of the can body as it must be robust enough to be flanged and secured to a can end. The angle $\theta$ representing the jet angle with respect to the base panel will vary according to the length of the can side wall and the range of can sizes to be processed to achieve proper air jet impingement. The size and spacing of the nozzles themselves are selected for the collective air jets forming air curtains of uniform air distribution to eliminate pulsation.

The base nozzles 62, 64, and 66 are spaced to envelope the entire can base in an air stream of each distribution, so that in each vertical pass and in the radius turns, the base of the can body instantaneously confronts substantially the same number of air jets and is immersed in a substantilly uniform air stream.

As a specific example of the present invention, a can body used for forming 12 ounce beverage cans and having a conventional exterior beer can decoration will be cured at oven speeds up to 1500 can per minute using side wall air nozzles of $\frac{3}{8}''$ diameter located on $\frac{3}{4}''$ centers issuing air jets at an angle $\theta$ of approximately 30 degrees at an air temperature of 430° F. Similarly, the base nozzles are arranged in three offset rows on either side of the conveying center line and being of $\frac{1}{4}''$ diameter located on $\frac{3}{4}''$ centers.

It is a further aspect of the present invention that the main louver wall comprising several vertical passes and the upper radius return zones are formed in a unitary main louver panel which is installed and removed as a unit from the oven. Similarly, the lower radius return zones are formed in a unitary panel for installation and removal from the oven. Such unitary construction provides for the desired air jet flows described above so that increased production speeds of up to 1500 cans per minute through the oven can be achieved. As shown in FIG. 2 the main louver panel 96 comprises several vertical passes 48 and a corresponding number upper radius return zones 58. A corresponding lower radius return panel 98 will have one more return zone 60 than the upper to accommodate entrance from and exit to adjacent main louver panels 96.

Referring to FIGS. 2, 3, 4, and 5 a preferred embodiment of the main louver panel 96 comprises six vertical passes 48 together with three upper radius return zones 58. The front wall 28 (FIGS. 2, 3) of the main louver panel has each vertical pass 48 oriented along the centerline of conveyor chain track 46 and has base nozzles 62 (FIG. 3) and side louver nozzles 84 as described above. Each vertical pass is provided with a separate pressure drop plenum chamber 86 (FIGS. 3 and 4) defined by a perforated pressure drop plate 88, and imperforate side 90, upper 97 and lower 99 walls. These imperforate walls cooperate to direct air flow from air supply plenum 32 (FIGS. 1 and 4) to curing chamber 34 through the pressure drop air plenum 86 in a direction substantially perpendicular to the louver wall 28. Adjacent vertical passes are joined to each other by spacer plates 100.

As shown in FIGS. 2, 4, and 5, each main louver panel 96 further includes three upper radius turn sections joining adjacent vertical passes. Each upper radius section includes perforated wall 50 having a nozzle pattern as shown, perforated pressure drop plate 88 and imperforate bottom 97, sides 102 (FIG. 2), and top 104 (FIG. 4) walls. The top wall includes a top plate 106 for securing the main louver panel to the oven frame 26. A suitable ferrule 108 is provided for clearing the sprocket and drive shaft assembly 44, 54 (FIG. 1) which support, guide, and move the conveyor chain. Curing air will pass through the perforated rear wall through the pressure drop plenum chamber in a direction substantially perpendicular to the face plate for passage through nozzles 62, 64 and 66. The imperforate top, bottom, and side walls assure such flow.

The lower end of each main louver wall terminates in a downwardly open channel 110 (FIG. 4) for mounting atop the lower radius panel 98.

Referring to FIGS. 2 and 4, the lower radius panels are also fabricated in modular form with the section illustrated in FIG. 2 joining the lower runs at eight adjacent vertical passes. The lower radius sections have perforated face plates 112 (FIG. 4) having nozzle patterns as described above, a perforated pressure drop rear plate 114 for passage of curing air from air supply plenum 32 to curing chamber 34 through pressure drop plenum 116. The top 118, bottom 120 and side walls 122 (FIG. 2) are imperforate, define the pressure drop plenum 116 and assure perpendicular air flow therethrough with respect to front face plates 112. The lower sections are each fitted with a ferrule 108 for clearing the sprocket and drive shaft assembly for supporting, guiding, and moving the carrier chain at its lower runs. Additionally, a mounting channel 124 nests with a supporting beam 126 for securing the lower radius panels to the oven frame 26.

It will be understood therefore that the top and lower radius turn louver panels 96 and 98 are of unit box construction and do not require any reinforcing steel for withstanding operating air pressures of approximately 18 psi in the air supply plenum chamber. Furthermore, the panels have the air straightening pressure drop plates 88 (FIG. 3) for each louver path separated from each other to prevent stray air currents moving laterally along the rear face of louver wall 28. The louver panels provide for easy removal of individual air straightening plates for periodic maintenance such as removal of accumulated condensate and cleaning, exchange of the panels when required due to changing coating technology systems, and exchange of the panels when switching to a can size not within the range covered by a given panel design. Several main louver panels are assembled in the oven by setting them with their bottom channels 110 (FIG. 4) over the top pate of the lower louver panels and bolting the top 106 to the roof of the oven and the sides to the adjacent louver panels. Preferably, the lower louver panels are permanently affixed to the oven.

It will be apparrent that the louver panels can be assembled to form a louver wall with six vertical passes or as many as twenty-four vertical passes. The oven size and the number of vertical passes depend on the required residence time in the oven for proper curing, which in turn depends on whether the can is of aluminum or steel and the types of coatings used. Six vertical passes would be typical for the shortest curing time and twenty-four vertical passes the longest.

In a pin oven according to the present invention, by reason of reducing flip-flopping in the transition between curvilinear and rectilinear movement of can bodies and by reducing can flutter in the curing zone we have substantially increased the upper range of can speed through pin ovens such that speeds up to 1500 cans per minute can now be expected. The cooler section of the oven is also fitted with main and lower louver panels and enjoys the full benefits and objects of the invention.

In practice, the improved nozzle design according to the invention immerses moving cans in a continuous air curtain resulting in an even and faster heat transfer to achieve a better cure of the coating or ink. Moreover the residence time of cans in the oven is reduced and the oven size can be reduced accordingly.

For special applications all vertical chain and louver passes can be changed to horizontal louver passes.

It will be apparent to those skilled in this art that various modifications could be made in the pin oven arrangement hereof without departing from the scope or spirit of the invention.

We claim:

1. A pin oven for curing can bodies having bases and upper side walls with jets of a curing medium comprising an oven chamber divided by an interior louver wall into a curing medium supply plenum chamber and a curing chamber, a plurality of spaced oven passes in said curing chamber being defined by adjacent sections of the interior wall, a series of members defining curved conveying paths between adjacent oven passes, carrier means having elements for supporting can bodies with base portions facing the interior louver wall and being arranged over the series of members to define a continuous conveying path of given centerline through each oven pass, a pair of louver members forming part of the interior wall and extending substantially the full length of each spaced oven path, each louver member being oriented at a converging angle with respect to the conveying path, and being defined by front and side walls joined at their edges to define a louver chamber, said angle being selected to direct air jets at the upper side wall of the can bodies, a series of perforations in each front wall providing a fluid path from plenum chamber to louver chamber and being spaced sufficiently close together to issue a curtain of uniformly distributed air toward the can side walls, a plurality of nozzles in the interior louver wall located on both sides of the centerline along the adjacent sections of the interior louver wall and along the curved conveying paths, said interior wall nozzles being arranged in a pattern for instantaneously confronting moving can bases with substantially the same number of nozzles for immersing the can bases in a substantially uniform air stream whereby the oven cures can bodies at oven speeds up to 1,500 cans per minute.

2. In a pin oven for curing can bodies having bases and upper body portions moving in a serpentine path defined by a continuing centerline, a louver panel comprising a plurality of substantially vertical passes in the louver panel, each vertical pass being aligned along a portion of the centerline of the serpentine path and lying in confronting relation with the base portion of the can bodies, said vertical pass having a plurality of rows of perforations arranged on both sides of the centerline of conveyance, such perforations being spaced sufficiently close together so as to instantaneously confront the can base with substantially the same number of perforations as the can moves through the vertical pass, a pair of side louvers forming part of the louver panel, each of said side louvers having a front wall with perforations oriented to issue converging curing jets toward the upper body portion of the can wall, said side wall perforations being located sufficiently close together to issue a substantially continuous air curtain toward the can body so that cans moving through the vertical pass are subjected to curing jets of substantially constant pressure and velocity so as to minimize can flutter whereby the oven cures can bodies at speeds in excess of 1,200 cans per minute.

3. An interior louver panel for a pin oven for curing coated can bodies having base and upper body portions having conveying means for moving cans along a serpentine path through the oven with means for carrying the can bodies with bases in confronting relationship with the louver panel, said louver panel comprising a plurality of substantially vertical passes lying along a given centerline of can travel on a front face of the panel, each vertical pass having a plurality of base nozzles therein evenly distributed across the centerline of travel and being located sufficiently close together instantaneously to confront each can base with substantially the same number of nozzles to issue a substantially uniform continuous air stream toward the can base, said vertical pass having a plurality of side louvers located on either side of the centerline and oriented to direct converging air jets toward the upper body portion of each can body said side louvers having perforations therein spaced sufficiently close together to issue a continuous curtain of air to envelope the can body side wall and to induce the base air jets to flow over the lower portion of the side wall of the can body, said louver panel further having a pressure drop plenum chamber on the reverse face thereof for supplying a curing medium through the base nozzles and side louver perforations, said plenum chamber being defined by a perforated air straightening pressure drop plate and imperforate top, bottom and side walls so that curing medium will flow through the pressure drop plate and through the plenum chamber in a direction substantially perpendicular to the interior louver panel.

4. An interior louver panel for a pin oven adopted for curing can bodies having base and upper body portions with jets of curing medium comprising a plurality of straight and curvilinear paths lying along a continuous centerline and defining a substantially serpentine path, each straight pass having a plurality of rows of base nozzles distributed on either side of the centerline of travel and spaced sufficiently together to continuously immerse the base of each can in a continuous air stream and to confront the base with substantially the same number of nozzles instantaneously, a pair of side louvers lying along opposite sides of the centerline of travel having side nozzles for directing converging air curtains toward the upper body portion of the can bodies, a plurality of nozzles in the front face of said panel distributed along the centerline of the curvilinear portion of the centerline and being distributed to immerse the base of each can in substantially the same number of air jets instantaneously as the can moves through the curvilinear path, a first pressure drop plenum chamber arranged along the rear face of the louver panel opposite the base and side nozzles and defined by a perforated pressure drop plate and by imperforate top, bottom and side walls, a second pressure drop plenum arranged at the rear face of the panel adjacent the curvilinear path and defined a perforated pressure drop plate and by imperforate top, bottom and side walls, and means for supplying curing air through said pressure drop plate in a direction substantially perpendicular to the louver panel said main louver panel being of unitary constructed for installation and removal from an oven.

5. A pin oven for curing coated cans with base and upper wall portions said oven having a curing medium supply chamber, a curing chamber, and return chamber, a louver panel separating the supply and curing chambers, means for recirculating and heating the medium within the oven, means for moving the cans through the oven in a serpentine path having alternating straight and curvilinear passes following a given centerline with the can bases in confronting relationship with the front face of the louver panel, said louver panel comprising a plurality of substantially straight passes lying along the centerline of can travel, each straight pass having a plurality of base nozzles therein evenly distributed across the centerline of travel and being located sufficiently close together instantaneously to confront each can base with substantially the same number of nozzles to issue a substantially uniform continuous air stream toward the can base, said straight pass having a plurality of side louvers located on either side of the centerline and oriented to direct converging air jets toward the upper body portion of each can body said side louvers having perforations therein spaced sufficiently close together to issue a continuous curtain of air to envelope the can body side wall and to induce the base air jets to flow over the lower portion of the side wall of the can body, said louver panel further having a pressure drop plenum chamber on the reverse face thereof for supplying a curing medium through the base nozzles and side louver perforations, said plenum chamber being defined by a perforated air straightening pressure drop plate and imperforate top, bottom and side walls so that curing medium will flow through the pressure drop plate through the plenum chamber in a direction substantially perpendicular to the interior louver panel.

6. A pin oven for curing coated open ended can bodies comprising a curing medium supply chamber, a curing chamber, a recirculation chamber, means for circulating medium within the chamber, means for heating the medium, conveyor means for moving the cans held by pins through a serpentine path having alterate straight and curved passes following a continuous centerline through the oven, a main louver panel and a lower radius section cooperating to define an internal wall separating the supply and curing chambers, the main louver panel having a front wall with front and rear faces, the front wall arranged along the serpentine path with its front face in confronting relationship with the bases of the moving cans, the front wall having a plurality of straight and curved passes opposite the straight and curved portions of the serpentine path, a plurality of rows of base nozzles in the front wall along the straight passes and lying on both sides of the centerline for issuing curing medium jets at the bases of the cans, said nozzles being spaced closely together to confront the moving cans with a given number of nozzles, and a pair of side louvers on opposite sides of the centerline for issuing converging air jets toward the side walls of the cans in a substantially continuous air curtain to immerse the side walls of the cans and to draw the base jets over the can body, a plurality of nozzles distributed along the centerline of the curved portion of the centerline and being distributed to immerse the base of each can in substantially the same number of air jets instantaneously as the can moves through the curvilinear path, a plurality of first pressure drop plenum chambers arranged along the rear face of the louver panel behind the base and side nozzles of each straight pass and defined by a perforated pressure drop plate and by imperforate top, bottom and side walls, a second plurality of pressure drop plenum chambers arranged at the rear face of the panel adjacent the curved path and defined a perforated pressure drop plate and by imperforate top, bottom and side walls, and means for supplying curing air through said pressure drop plates in a direction substantially perpendicular to the louver panel said main louver panel being of unitary constructed for installation and removal from an oven, said main louver panel having means for supporting, guiding and moving the conveyor through adjacent curved passes of the serpentine path, a lower radius panel having perforated front and rear walls and imperforate top, bottom and side walls, the perforated front wall having a series of nozzles arranged to instantaneously confront the base of each moving can with the same number of nozzles and lying along the curved centerline, said main louver panel being mounted on the lower radius panel in defining the internal wall, and the lower radius panel having means for supporting, guiding, and moving the conveyor through adjacent curved passes of the serpentine path.

7. An interior louver panel for a pin oven for curing coated can bodies having base and body portions, said louver panel having a front wall defining a plurality of substantially vertical passes each lying along a given centerline of can travel, each vertical pass having a plurality of base nozzles therein, each vertical pass having a plurality of side louvers located on either side of the centerline and oriented to direct converging air jets toward the upper body portion of each can body, said louver panel further having a plurality of pressure drop plenum chambers on the reverse face thereof for supplying curing medium through the base nozzles and side louver perforations of the plurality of vertical passes, each plenum chamber being defined by said front wall, a perforated air straightening pressure drop plate, and imperforate top, bottom, and side walls so that curing medium flows through the pressure drop plate ad through the plenum chamber in a direction substantially perpendicular to the interior louver panel front wall, and to eliminate air currents moving laterally of the rear face of the front wall between vertical passes.

8. An interior louver panel for a pin oven adopted for curing can bodies having base and upper wall portions with jets of a curing medium comprising a plurality of straight and curvilinear paths lying along a continuous centerline and defining a substantially serpentine path, each straight pass having a plurality of rows of base nozzles distributed on either side of the centerline of travel and being sized and spaced according to a given range of can body sizes to continuously immerse the base of each can in a continuous air stream and to confront the base with substantially the same of number of nozzles instantaneously, a pair of side louvers lying along opposite sides of the centerline of travel having side nozzles for directing converging air curtains toward the upper body portion of the can bodies, a plurality of nozzles in the front face of said panel distributed along the centerline of the curvilinear portion of the centerline and being distributed to immerse the base of each can in substantially the same number of air jets instantaneously as the can moves through the curvilinear path, and means for supplying a curing medium through said nozzles so that moving can bodies are immersed in a continuous air curtain to prevent can flip-flopping when passing through vertical passes.

9. An interior louver panel for a pin oven adopted for curing can bodies having base and upper wall portions with jets of a curing medium comprising a plurality of straight and curvilinear paths lying along a continuous centerline and defining a substantially serpentine path, each straight pass having a plurality of rows of base nozzles distributed on either side of the centerline of travel and being sized and spaced according to a given range of can body sizes to continuously immerse the base of each can in a continuous air curtain and to confront the base with substantially the same of number of nozzles instantaneously, a pair of side louvers lying along opposite sides of the centerline of travel having side nozzles for directing continuous converging air curtains toward the upper body portion of the can bodies, a plurality of nozzles in the front face of said panel distributed along the centerline of the curvilinear portion of the centerline and being distributed to immerse the base of each can in substantially the same number of air jets instantaneously as the can moves through the curvilinear path, and means for supplying a curing medium through said nozzles so that the continuous air curtains provide rapid and even curing of cans and reduce oven residence time.

10. A pin oven for curing can bodies with jets of a curing medium comprising an oven chamber divided by an interior louver wall into a curing medium supply plenum chamber and a curing chamber, a plurality of spaced oven passes in said curing chamber being defined by adjacent sections of the interior wall, a series of members defining curved conveying paths between adjacent oven passes, carrier means having elements for supporting can bodies with base portions facing the interior louver wall and being arranged over the series of members to define a continuous conveying path of given centerline through each oven pass, a pair of louver members forming part of the interior wall and extending substantially the full length of each spaced oven path, each louver member being oriented at a converging angle with respect to the conveying path, and being defined by front and side walls joined at their edges to define a louver chamber, said angle being selected to direct air jets at the upper side wall of the can bodies, a series of perforations in each front wall providing a fluid path from plenum chamber to louver chamber and being spaced sufficiently close together to issue a curtain of uniformly distributed air toward the can side walls, a plurality of nozzles in the interior louver wall located on both sides of the centerline along the adjacent sections of the interior louver wall and along the curved conveying paths, the centerline of the curved conveying paths defining outer and inner concentric paths, and further comprises a continuation of the plurality of rows of nozzles located along the outer concentric path and a single row of nozzles along the inner concentric path, said interior wall nozzles being arranged in a pattern for instantaneously confronting moving can bases with substantially the same number of nozzles for immersing the can bases in a substantially uniform air stream.

* * * * *